US007554420B2

(12) United States Patent
Nishimura

(10) Patent No.: US 7,554,420 B2
(45) Date of Patent: Jun. 30, 2009

(54) HIGH-FREQUENCY ELEMENT

(75) Inventor: Noriaki Nishimura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 278 days.

(21) Appl. No.: 11/642,585

(22) Filed: Dec. 21, 2006

(65) Prior Publication Data

US 2007/0159267 A1 Jul. 12, 2007

(30) Foreign Application Priority Data

Dec. 28, 2005 (JP) ..... 2005-379104

(51) Int. Cl.
*H01P 1/22* (2006.01)

(52) U.S. Cl. ..... 333/81 A; 333/22 R

(58) Field of Classification Search ..... 333/81 A, 333/22 R

See application file for complete search history.

(56) References Cited

U.S. PATENT DOCUMENTS 4,272,739 A * 6/1981 Nesses ..... 333/81 A
4,660,921 A * 4/1987 Hauver ..... 439/578
6,903,621 B2 * 6/2005 Malcolm et al. ..... 333/81 A
2004/0233011 A1 11/2004 Malcolm et al.

OTHER PUBLICATIONS

Gary Coffman, "Aluminum Soldering", Feb. 17, 2001, yarchive.net.*
European Search Report, May 2, 2007.

* cited by examiner

*Primary Examiner*—Benny Lee
*Assistant Examiner*—Gerald Stevens
(74) *Attorney, Agent, or Firm*—Kubotera & Associates, LLC

(57) ABSTRACT

An element includes a member to be soldered, a first member having a firs path for receiving the member, and a second member having a second path for receiving the member. The second member is made of a material that has a soldering ability higher than that of the first member. The member received in the first and second paths is soldered to the second path.

10 Claims, 6 Drawing Sheets

HIGH-FREQUENCY ELEMENT

BACKGROUND OF THE INVENTION

1. Field of the Invention

The present invention relates to high-frequency elements and, more specifically, to an h-f element within which a member, such as a resistance board, is soldered.

2. Description of the Related Art

FIG. 7 shows an h-f element or connection tube in which a soldering is made. This connection tube is useful for an h-f device with an attenuation function. United States Patent 2004-0233011 discloses an attenuator as an h-f device with an attenuation function. The conventional element 90 has a resistance board 92 that extends along a path 93. Soldering is made near the resistance board 92 and a surface 91 of the connection tube 90.

In the conventional element 90, however, the solder is mounted on the surface 91 of the connection tube 90 so that the accuracy of the product is decreased.

SUMMARY OF THE INVENTION

Thus, it is an object of the invention to provide an element having a soldering area completely within the element, thereby preventing the soldering area from deforming the surface shape.

According to the invention there is provided a high-frequency element comprising a member to be soldered; a first member having a first path for receiving the member; a second member having a second path for receiving the member and made of a material that is better in soldering ability than the first member; and the member being soldered at the second path of the second member.

The second member may be made of gold-plated brass and the first member may be made of aluminum. The h-f element may further comprise a third member having a third path for receiving the member so that the member is soldered at the second path of the second member. The third member may be made of the same material as that of the first member. The first path of the first member may be made larger than that of the other member. The member may be in form of a flat plate, opposite sides of which are held horizontally by the paths. The member may be a resistance board. The element may be used for an h-f device.

According to another aspect of the invention there is provided a high-frequency element having an attenuating function and including a first component and a second component. The first component comprising a resistance board; a relay terminal attached to the resistance board; a plurality of first connection tubes made of a metal that is not suitable for soldering and having a first path for receiving the resistance board; a second connection tube flanked by the first connection tubes and made of a second metal suitable for soldering and having a second path for receiving the resistance board; the resistance board having a ground connection section soldered by reflow to the second path of the second connection tube and a signal connection section attached to the relay terminal such that the relay terminal extends outwardly from the second connection tube to the first connection tubes.

The second component comprising a terminal section to be connected electrically to a central conductor of a mating coaxial connector; an outer conductor to be connected electrically to an outer conductor of the mating coaxial connector; the terminal section being connected to the signal connection section of the resistance board via the relay section of the first component; the outer conductor being connected to the ground connection section of the resistance board via the first connection tubes and the second connection tube.

The second components may flank the first component. The h-f element may further comprise a shell for covering the first component and the second component.

According to the invention it is possible to mount the h-f element without leakage of the solder.

DESCRIPTION OF THE PREFERRED EMBODIMENTS

An h-f device using an h-f element according to an embodiment of the invention will now be described below with respect to the accompanying drawing. An attenuator will be described as an example of the h-f device but it is appreciated that the h-f element according to the invention is useful for a variety of other h-f devices.

Figure 1:
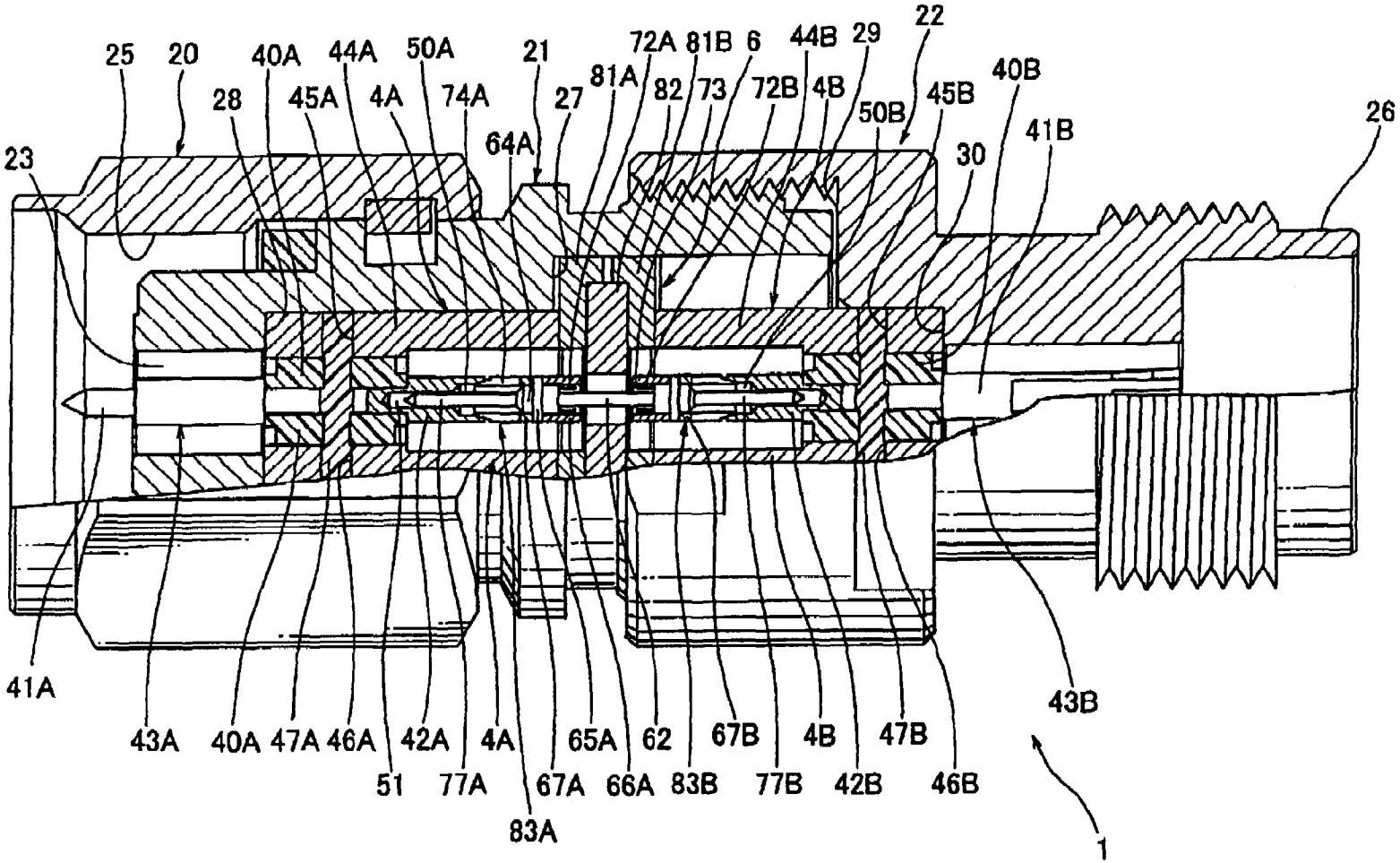
FIG. 1 is a sectional view taken along the center line of an h-f device.

In FIG. 1, the h-f device 1 includes three substantially cylindrical members; i.e., a screw portion 20, a first shell 21, and a second shell 22. The screw portion 20 is secured to the front portion of the first shell 21 and used for attaching the h-f device 1 to a mating coaxial connector (not shown). The second shell 22 is secured to the rear portion of the first shell 21. The first shell 21 houses a first component 4A and a second component 6. The second shell 22 houses the rear portion of a third component 4B.

The screw member 20 is bored with a predetermined diameter to house the front portion of the first shell 21. This screw member 20 can be attached to a mating coaxial connector that has the same shape as the rear portion 26 of the second shell 22. Thus, the h-f device 1 is able to connect two coaxial connectors.

The first shell 21 has a plurality of inner diameters. A shoulder 27 is provided between a rear large diameter bore and an intermediate diameter bore and a shoulder 28 is provided between the intermediate diameter bore and a front small diameter bore. The shoulder 27 is opposed to the second component 6 and the flange 28 is abutted against the front side of the first component 4A to prevent the first shell 21 from coming off from the front.

The second shell 22 has a plurality of inner diameter bores. A shoulder 29 is provided between a front large diameter bore and an intermediate diameter bore and a shoulder 30 is provided between the intermediate diameter bore and a small diameter bore. The inner diameter of a rear threaded portion 26 is set relatively large for connection with a predetermined connector (not shown). The shoulder 29 is opposed to the rear end of the first shell 21 and the shoulder 30 is abutted against the rear end of the first (third) component 4B to prevent the second shell 22 from coming off from the back.

An inside of the thread member 20 may be threaded on an area 25 opposed to the first shell 21. By connecting this threaded area with the threaded area of a mating coaxial connector (not shown), it is possible to connect the h-f device 1 with the mating coaxial connector via the thread member 20.

The first component 4A, the second component 6, and the first component 4B are placed in the first shell 21 such that a portion of the first component 4A is abutted against the shoulder 28 of the first shell 21. Then, the second shell 22 is attached to the rear end of the first shell 21 so that the first component 4A, the second component 6, and the first component 4B is held in the h-f device 1 with a constant axial distance between them. The function of the h-f device 1 may be changed by setting the function of the second component 6. For example, the h-f device 1 functions as attenuator by providing the second component 6 with a resistor 62. Alternatively, the thread member 20 may be replaced with a push-on lock. Furthermore, the thread member 20 may be provided on a mating coaxial connector.

The first components 4A and 4B will be described below in more detail. They have an identical shape except that a first male terminal 41A and a first female terminal 41B are slightly different. They are provided symmetrically on opposite sides of the second component 6.

The first component 4A is composed of a terminal member 43A having a first male terminal 41A, a second female terminal 42A, and an insulating member 40A between them and an outer conductor 44A to cover the terminal member 43A. The first component 4B is composed of a terminal member 43B having a first female terminal 41B, a second female terminal 42B, and an insulating member 40B between them and an outer conductor 44B to cover the terminal member 43B. The first male terminal 41A of the first component 4A has a pin shape while the first female terminal 41B of the first component 4B has a cylindrical shape to house the first male terminal of a mating coaxial connector. The first components 4A and 4B are different in this respect but this difference is insignificant because it results from the first male terminal shape of the mating coaxial connector.

The outer conductors 44A and 44B are attached to the terminal members 43A and 43B with a resin. The terminal members 43A and 43B are placed in the outer conductors 44A and 44B. Then, alignment apertures 45A, 45B, 46A, 46B are aligned and filled with resins 47A and 47B to secure them in predetermined orientations.

In use, the outer conductor 44A of the first component 4A is connected electrically to the outer conductor of a mating coaxial connector (not shown). The terminal member 43A of the first component 4A is connected electrically to the central conductor of a mating coaxial connector (not shown) by means of the first make terminal 41A.

The signal received by the outer conductor 44A is transmitted to the outer conductor 44A of the first component 4B via the first connection tubes 81A and 81B, and the second connection tube 82 of the second component 6. The signal received by the first male terminal 41A is transmitted to the relay section 83A of the second component 6 and the resistance board 62 via the second female terminal 42A. After attenuated by the resistance, the signal is transmitted to the first female terminal 41B.

As described above, the h-f device 1 is used to connect a first connector connected to the first shell 21 and a second connector connected to the second shell 22 with the attenuation function added.

Figure 2:
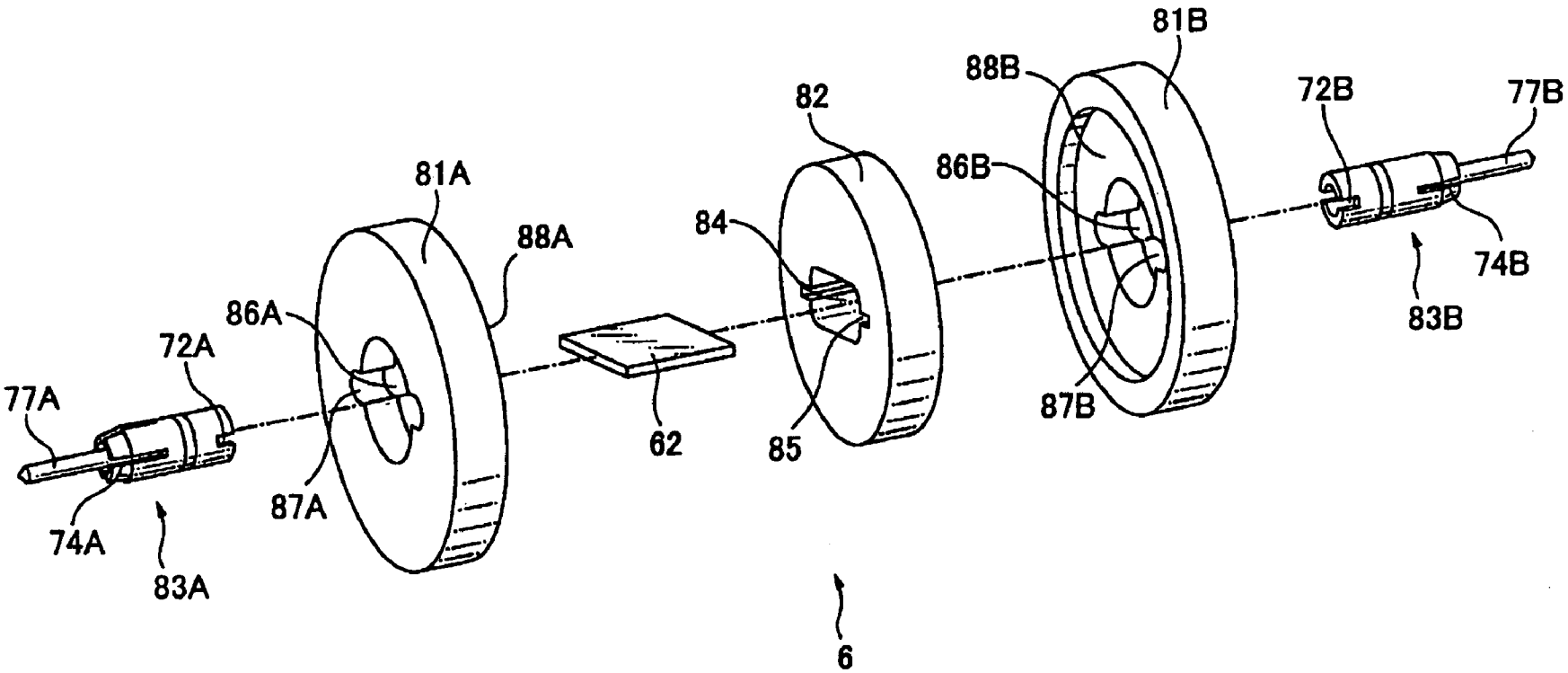
FIG. 2 is an exploded perspective view of the second component.
Figure 3:
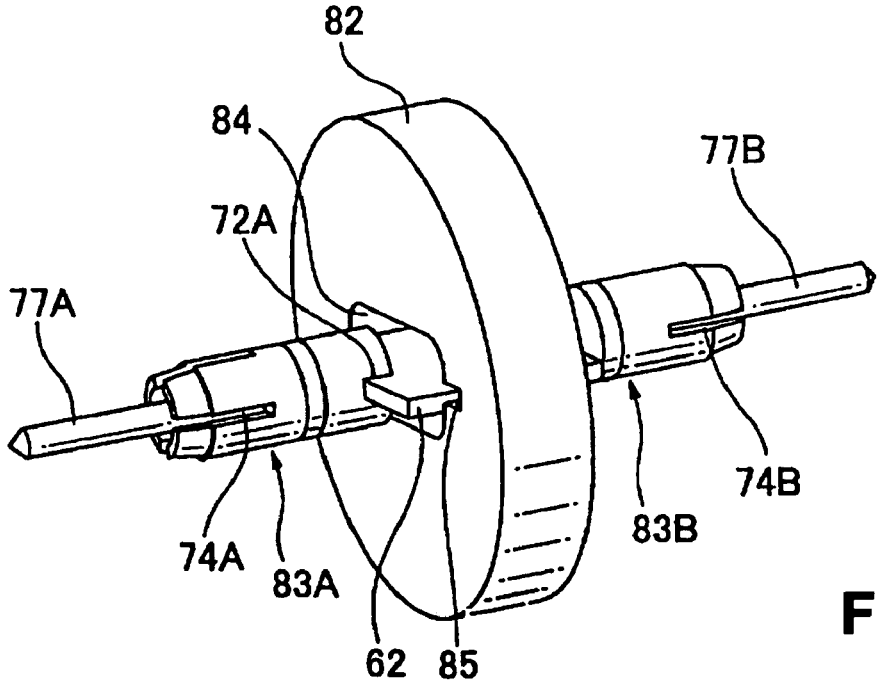
FIG. 3 is a perspective view of the second component under construction.
Figure 4:
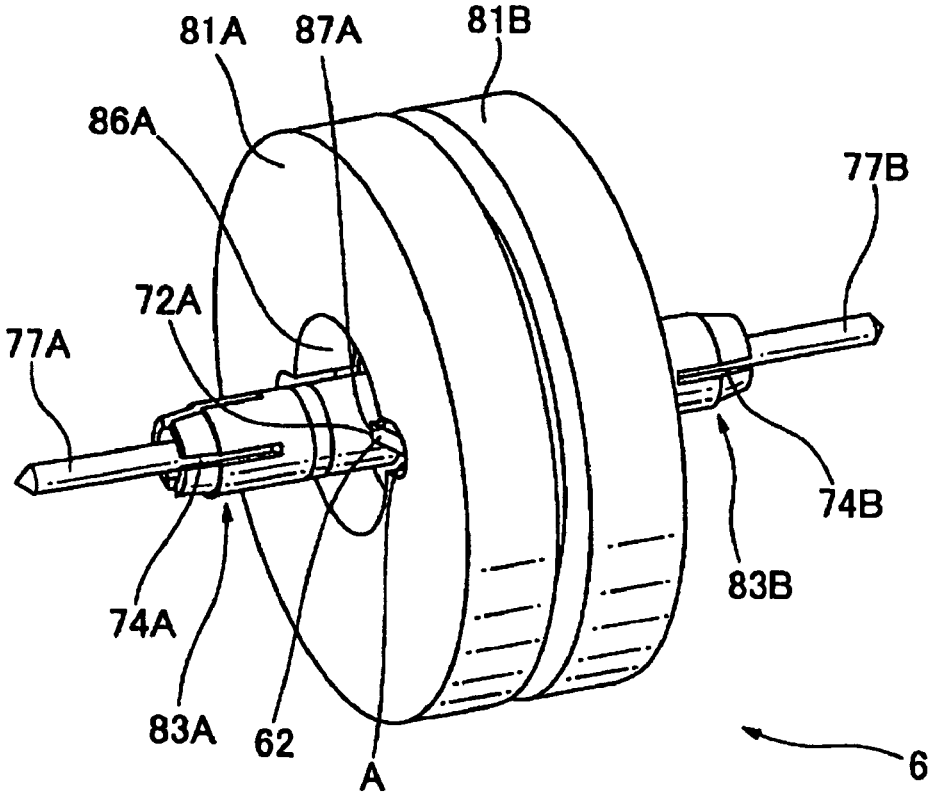
FIG. 4 is a perspective view of the second component completed.
Figure 5:
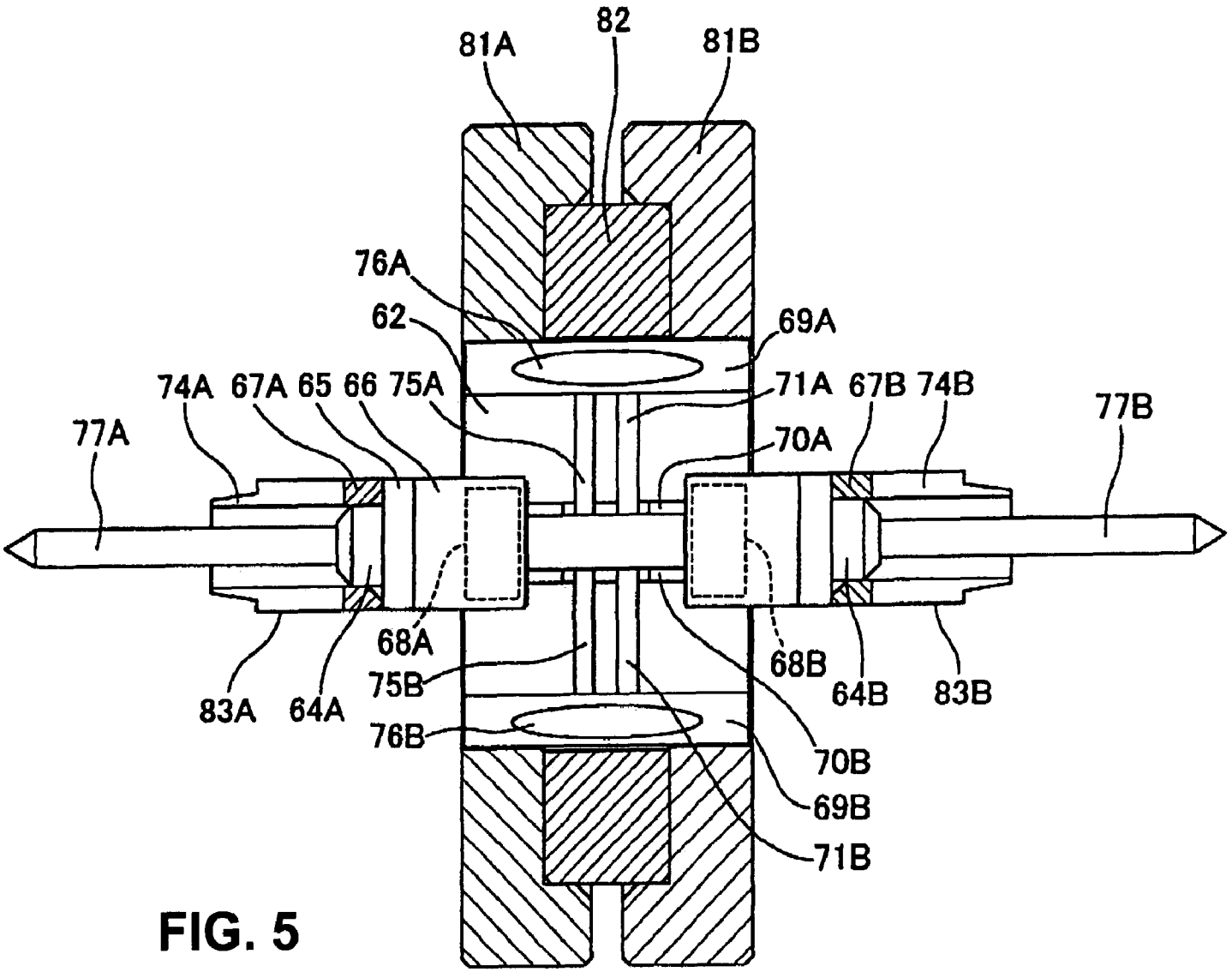
FIG. 5 is a sectional view of the second component.

The second component 6 will be described in more detail with reference to FIGS. 1-5. FIG. 2 is an exploded perspective view of the second component 6. FIG. 3 shows an intermediate product. FIG. 4 shows a completed second component. FIG. 5 is a sectional view take along the upper surface of the resistance board 62.

The second component 6 has a symmetrical shape and includes a second connection tube 82 provided at the central position, two first connection tubes 81A and 81B provided on opposite sides of the second connection tube 82, a resistance board 62 passed through the second and first connection tubes 82 and 81A and 81B, and relay sections 83A and 83B attached to opposite ends of the resistance board 62.

The second connection tube 82 is made of a gold plated brass or other material that has good conductivity and is better in soldering ability than the first connection tubes 81A and 81B and has the form of a circular plate with a predetermined thickness. The second connection tube 82 has a rectangular hole 84 at the center and rectangular paths 85 opened at the rectangular hole 84 to receive the resistance board 62. The thickness of each rectangular path 85 is made substantially equal to or slightly greater than the thickness of the resistance board 62. The resistance board 62 is placed in the rectangular paths 85 under horizontal conditions.

The first connection tubes 81A and 81B are made in the form of a circular plate having a predetermined thickness and a diameter greater than that of the second connection tube 82. Unlike the second connection tube 82, the first connection tubes 81A and 81B are made of aluminum or other material that is not suitable for soldering. The first connection tubes 81A and 81B are provided with circular holes 86A and 86B, the diameter of which is substantially equal to the horizontal length of the rectangular hole 84 of the second connection tube 82.

In order to receive the resistance board 62 with clearance, semi-circular paths 87A and 87B are provided on the circular holes 86A and 86B, respectively, so that the length between the ends of semi-circular paths 87A and 87B is equal to or slightly greater than the width of the resistance board 62. The thickness of each path 87A or 87B is greater than the thickness of the resistance board 62 and thus the thickness of the rectangular path 85 so that the resistance board 62 does not touch upper and lower surfaces of the semi-circular paths 87A and 87B. Circular indentations 88A and 88B are provided in inner side of the first connection tubes 81A and 81B, respectively, to accommodate the second connection tube 82.

The depth of the circular indentations 88A and 88B is less than a half of the thickness of the second connection tube 82 so that the first connection tubes 81A and 81B are spaced when the second connection tube 82 is accommodated in the circular indentations 88A and 88B. Consequently, the gold-plated brass of the first connection tube 81A and 81B are brought into contact with the aluminum of the second connection tube 82 and the rectangular path 85 is aligned with the semi-circular paths 87A and 87B. The three components according to the invention make it possible to work in one direction, thus making the work easier.

The resistance board 62 is a symmetric flat chip-type resistor which is incorporated in the rectangular path 85 of the second connection tube 82 and the semi-circular paths 87A and 87B of the first connection tubes 81A and 81B. As best shown in FIG. 5, it has a pair of signal connection sections 68A and 68B on parts of opposite sides thereof and a pair of ground connection sections 69A and 69B on the entire lengths of the other opposite sides thereof. The similarly shaped resistance pattern is formed on the rear surface of the resistance board 62. The signal connection sections 68A and 68B are connected by parallel signal lines 70A and 70B, which are connected to the ground connection sections 69A and 69B by two ground lines 71(A, B) and 75(A, B) so that a predetermined resistance is provided on the signal flow between the signal connection sections 68A and 68B for attenuation.

To assemble an h-f device, the signal connection sections 68A and 68B are soldered to the relay sections 83A and 83B for electrical connection with the central conductor of a mating coaxial connector. To facilitate connection to the relay sections 83A and 83B, the signal connection sections 68A and 68B have relatively large connection areas. The ground connection sections 69A and 69B of the resistance board 62 are soldered to the rectangular path 85 of the second connection tube 82 so that it is connected electrically to the outer conductors 44A and 44B (FIG. 1) and the outer conductor of a mating coaxial connector via the second connection tube 82 and the first connection tubes 81A and 81B.

The soldering to the second connection tube 82 of the ground connection sections 69A and 69B of the resistance board 62 is made by placing a paste solder in the space between the ground connection sections 69A and 69B and the semi-circular path 87A(B) and melting the paste solder for reflow after the second component 6 is completed as shown in FIG. 4. The molten solder flows into the solder-friendly second connection tube 82 from the hardly soldering first connection tubes 81A and 81B via the gap between the rectangular path 85 and the semi-circular paths 87A and 87B for mounting the resistance board with solders 76A and 76B near the rectangular path 85 of the second connection tube 82.

Thus, in accordance with the invention, by differentiating the materials of the second connection tube 82 and the first connection tubes 81A and 81B and forming a capillary path between the second connection tube 82 and the first connection tubes 81A and 81B, it is possible to put the mounting solder at the predetermined location in the second connection tube 82 between the first connection tubes 81A and 81B to prevent solder leak from the first connection tubes 81A (81B). Consequently, the contact surface is not deformed, which stabilizes not only the ground connection with the first component 4A and 4B (outer conductors 44A and 44B) but also the assembling with a small amount of solder.

In accordance with the invention, the simple three components or the second connection tube 82 and the first connection tubes 81A and 81B are used to simplify the assembling form. Alternately, the solder may be screen printed on the ground connection section of the resistance board 62, which is placed in the path for reflow.

Referring back to FIG. 1, the structure of the relay section 83 is described. It includes connection terminals 64A and 64B for connection with the resistance board 62, flanges 65A and 65B, joint tubes 66A and 66B on the side of the second connection tube 82 and the first connection tubes 81A and 81B and relay tubes 67A and 67B on the side of the first components 4A and 4B.

At ends of the relay sections 83A and 83B there are provided slit members 72A and 72B that have a semi-circular section with slits into which the signal connection sections 68A and 68B of the resistance board 62 are press fitted. Then, the solders 73A and 73B are put in the slit members 72A and 72B to secure the relay sections 83A and 83B to the resistance board 62. The relay sections 83A and 83B extends outwardly from the first connection tubes 81A and 81B. It is noted that the solder is put on the entire circumferential surface of the slit members 72A and 72B.

When the first components 4A and 4B and the second component 6 are connected, they are connected resiliently with the spring structure composed of the relay tube 67 of the second component 6 and the second female terminals 42A and 42B of the first components 4A and 4B. To male this spring structure, the relay tubes 67A and 67B are provided with lateral slits 74A and 74B on the connection sides with the first components 4A and 4B. First, the guide pins 77A and 77B extending from the connection terminals 64A and 64B of the second component 6 enters the holes 50A and 50B of the second female terminals 42A and 42B of the first components 4A and 4B. Then, the guide pins 77A and 77B are guided into the guide holes 51 while the slits 74A and 74B of the relay tubes 67A and 67B are pressed into the entrance holes 50A and 50B of the second male terminals 42A and 42B for resilient deformation.

Consequently, the first components 4A and 4B are connected to the second component 6 resiliently. This resilient connection removes the stress caused by the connection between the h-f device 1 (male terminal) and the mating coaxial connector (female terminal), tolerates the gap between the terminals, and makes no or little stress on the soldered section between the resistance board 62 and the relay sections 83A and 83B (slit members 72A and 72B) and between the resistance board 62 and the second connection tube 82 (85).

Figure 6:
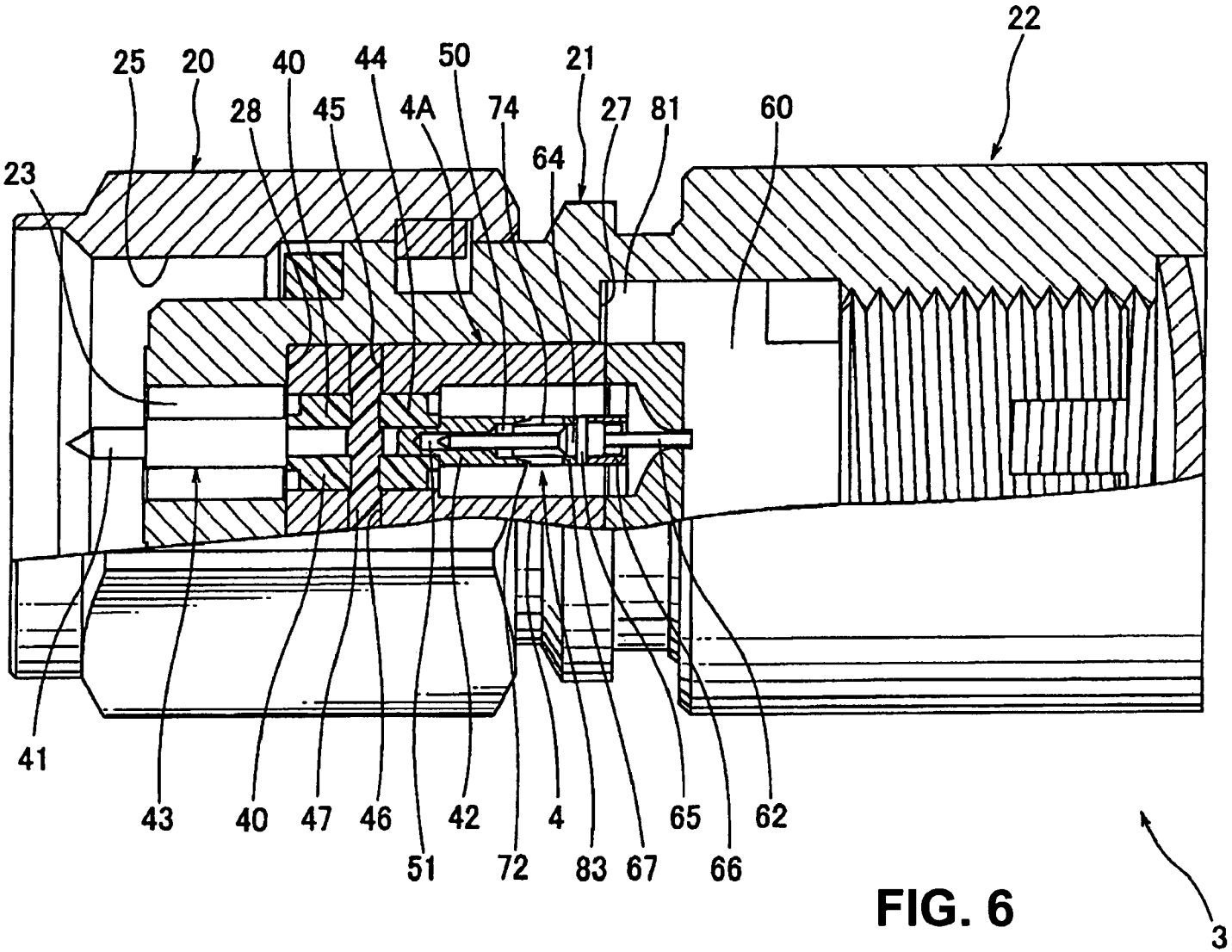
FIG. 6 is a h-f terminator according to another embodiment of the invention.
Figure 7:
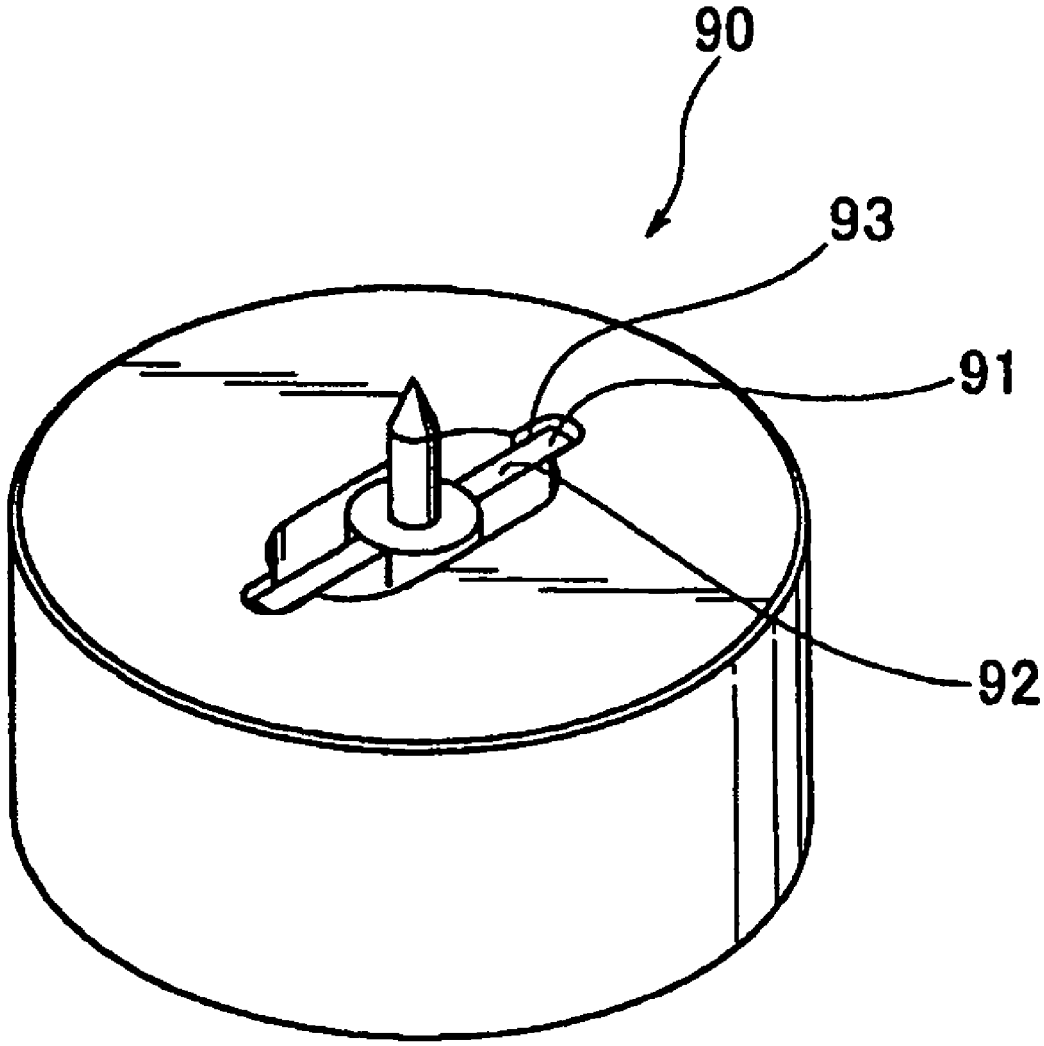
FIG. 7 PRIOR ART
FIG. 7 is a perspective view of a conventional attenuator.

The invention is applicable not only to the attenuator but also a terminator 3 such as shown in FIG. 6, wherein the relay section 83 extend in one direction and the other end is grounded with the ground conductor 60. The ground side is made of a solder-friendly material and the relay side is made of a hardly soldered material. In FIG. 6, the same reference numerals are provided on the similar members to those of FIG. 1. The invention is applicable to a variety of devices in which a resistance board is soldered.

The invention claimed is:

1. A high-frequency element having an attenuating function and including a first component and a second component;

said first component comprising:

a resistance board;

a relay terminal attached to said resistance board;

a plurality of first connection tubes made of a metal that is not suitable for soldering and having a first path for receiving said resistance board;

a second connection tube flanked by said first connection tubes and made of a second metal suitable for soldering and having a second path for receiving said resistance board;

said resistance board having a ground connection section soldered by reflow to said second path of said second connection tube and a signal connection section attached to said relay terminal such that said relay terminal extends outwardly from said second connection tube to said first connection tubes; and said second component comprising:

a terminal section to be connected electrically to a central conductor of a mating coaxial connector;

an outer conductor to be connected electrically to an outer conductor of said mating coaxial connector;

said terminal section being connected to said signal connection section of said resistance board via said relay section of said first component;

said outer conductor being connected to said ground connection section of said resistance board via said first connection tubes and said second connection tube.

2. The h-f element according to claim 1, wherein said second components flank said first component.

3. The h-f element according to claim 1, which further comprises a shell for covering said first component and said second component.

4. A high-frequency (h-f) element comprising:

a member to be soldered;

a first member having a first path for receiving said member, said first member being made of aluminum;

a second member having a second path for receiving said member and made of gold-plated brass; and said member being soldered at said second path of said second member.

5. The h-f element according to claim 4, which further comprises a third member having a third path for receiving said member so that said member is soldered at said second path of said second member.

6. The h-f element according to claim 5, wherein said third member is made of the same material as that of said first member.

7. The h-f element according to claim 4, wherein said first path of said first member is made larger than that of the second member.

8. The h-f element according to claim 4, wherein said member is in form of a flat plate, opposite sides of which are held horizontally by said paths.

9. The h-f element according to claim 4, wherein said member is a resistance board.

10. An h-f device having said element according to claim 4.

* * * * *